US011267496B2

(12) United States Patent
Kuchar et al.

(10) Patent No.: US 11,267,496 B2
(45) Date of Patent: Mar. 8, 2022

(54) VEHICLE SYSTEM

(71) Applicant: Transportation IP Holdings, LLC, Norwalk, CT (US)

(72) Inventors: Edward J. Kuchar, Cedar Rapids, IA (US); Andrew Ryan Staats, Cedar Rapids, IA (US); James Allen Oswald, Coggon, IA (US); Shannon K. Struttmann, Cedar Rapids, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 151 days.

(21) Appl. No.: 16/685,485

(22) Filed: Nov. 15, 2019

(65) Prior Publication Data

US 2021/0146973 A1 May 20, 2021

(51) Int. Cl.
*B61L 15/00* (2006.01)
*B61L 23/22* (2006.01)

(52) U.S. Cl.
CPC ..... *B61L 15/0018* (2013.01); *B61L 15/0072* (2013.01); *B61L 23/22* (2013.01)

(58) Field of Classification Search
CPC ... B61L 15/0018; B61L 15/0072; B61L 23/22
See application file for complete search history.

(56) References Cited

U.S. PATENT DOCUMENTS 6,996,461 B2 7/2006 Kane
7,236,860 B2 6/2007 Kane
7,467,032 B2 12/2008 Kane
7,742,850 B2 6/2010 Kane
8,714,494 B2 6/2014 Weber
9,002,545 B2 7/2015 Wilson
9,168,936 B2 10/2015 Grimm
9,233,698 B2 1/2016 Weber
9,283,945 B1 3/2016 Kemwein
9,460,566 B2 4/2016 Allwardt
9,469,310 B2 10/2016 Kemwein
9,846,025 B2 12/2017 Kirchner
9,950,718 B2 4/2018 Naylor
10,077,033 B2 9/2018 Oswald
10,081,378 B2 9/2018 Ruhland
2009/0105920 A1 5/2009 Fenske
2016/0075356 A1 3/2016 Kull
2017/0043797 A1 2/2017 Allshouse
2017/0313332 A1* 11/2017 Paget ..... H04N 7/183
2019/0106135 A1* 4/2019 Kumar ..... B61L 15/0081
2019/0176862 A1* 6/2019 Kumar ..... G06K 9/00651

* cited by examiner

*Primary Examiner* — Russell Frejd

(74) *Attorney, Agent, or Firm* — The Small Patent Law Group LLC; Mary D. Lawlor

(57) ABSTRACT

A system and a method may include one or more sensors disposed onboard a vehicle that may sense one or more characteristics of the vehicle. The system may include one or more processors configured to determining an identification of a switch on a route along which a vehicle moves using one or more sensors onboard the vehicle. A location of the switch is identified with the one or more sensors. A state of the switch is determined with the one or more sensors. The identification of the switch, location of the switch, and the state of the switch are communicated with an off-board database.

20 Claims, 2 Drawing Sheets

VEHICLE SYSTEM

BACKGROUND

Technical Field

The subject matter described relates to systems and methods that monitor switches of a route with a vehicle.

Discussion of Art

Some transportation networks include routing devices or systems that direct a vehicle from moving in one direction, to move in a different direction. For example, switches on rail routes may change the direction of a rail vehicle to move long one segment of the rail route to move along a different segment of the rail route. Alternatively, the routing devices may also be a traffic light that directs pedestrians, automobiles, or the like, from moving along one path, to move along a different path.

But, one or more characteristics of these routing devices may be unknown, such as locations, a state (e.g., a health, status, or the like). For example, if a vehicle is moving along a route and comes upon a routing device, such as a traffic light or a rail switch, and the state of the routing device is incorrect, then the vehicle may continue moving in an incorrect direction, or the vehicle may need to stop in order to correct the direction of movement. This can pose a safety risk if the vehicle continues traveling in the incorrect direction or if the vehicle stops on the route.

BRIEF DESCRIPTION

In one or more embodiments, a method includes determining an identification of a switch on a route along which a vehicle moves using one or more sensors onboard the vehicle. A location of the switch is identified with the one or more sensors. A state of the switch is determined with the one or more sensors. The identification of the switch, location of the switch, and the state of the switch are communicated with an off-board database.

In one or more embodiments, a vehicle system includes one or more sensors disposed onboard a vehicle that may sense one or more characteristics of the vehicle. The vehicle system includes one or more processors configured to determine an identification of a switch on a route along which the vehicle moves, identify a location of the switch, determine a state of the switch, and communicate the identification of the switch, the location of the switch, and the state of the switch with an off-board database.

In another embodiment, a method may include determining an identification of a switch on a route along which a first vehicle of a vehicle consist moves using one or more sensors onboard the first vehicle. A location of the switch may be identified with the one or more sensors. A state of the switch may be determined with the one or more sensors. The state of the switch may be confirmed using one or more sensors onboard a second vehicle of the vehicle consist. The identification of the switch, the location of the switch, and the state of the switch may be communicated with an off-board database to confirm the identification of the switch, the location of the switch, and the state of the switch with the off-board database.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
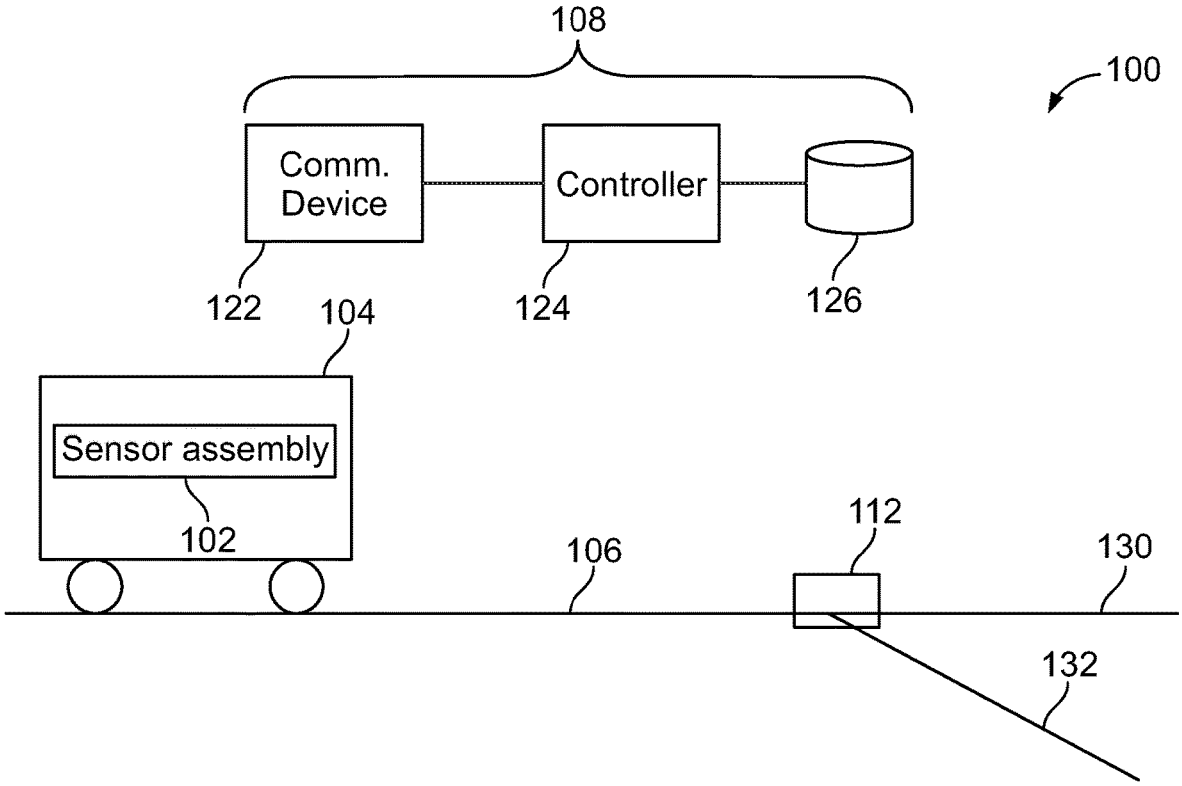
FIG. 1 schematically illustrates one example of a system.

Embodiments of the subject matter described herein relate to vehicle systems and methods that identify characteristics of routing devices, and communicate the characteristics with a database that is off-board the vehicle system. In one embodiment, the vehicle system can be a rail vehicle system that includes one or more sensor assemblies. The sensor assemblies can measure, detect, or otherwise sense one or more characteristics of the vehicle as the vehicle moves along a route.

The sensor assemblies can determine whether the sensed characteristics of the vehicle indicates an issue with the vehicle system. For example, the sensor assembly can determine whether the vehicle is moving in a correct direction or moving, in an incorrect direction. Based on the one or more sensed characteristics of the vehicle, the sensor assembly can determine one or more characteristics of a route device, such as a switch on the route along which the vehicle moves. The one or more sensed characteristics may include an identification of the switch, a location of the switch, and a state of the switch. For example, the switch may be in a first position or in a second position. The first position may be a correct position such that the vehicle correctly moves in a first direction, and the second position may be an incorrect position such that the vehicle incorrectly moves in a different direction. The state of the switch may optionally refer to a health of the switch. For example, one or more components of the switch may have deteriorated and may require repair.

In one example, the sensor assembly can communicate a sensor signal (e.g., a digital signal, a radio signal, or the like) to a vehicle controller. This onboard vehicle controller can change operation of the vehicle system responsive to receiving the sensor signal, such as by slowing or stopping movement of the vehicle system. In one example, the onboard controller can be an onboard computer that is used in a positive train control system. The sensor assemblies optionally can communicate the sensor signal, including at least the identification of the route device, the location of the route device, and the state of the route device with an off-board database, such as a back-office server of the positive train control system. This server can use the sensor signal to automatically control one or more operational settings of the vehicle (e.g., a brake setting and/or a throttle setting), to communicate the information to another vehicle that moves along the route, to alert an operator onboard the vehicle, to direct the operator onboard the vehicle to manually change one or more operational settings of the vehicle, or the like. Optionally, this server can use the sensor signal to schedule repair, inspection, or maintenance of the route device.

While some embodiments described herein relate to rail, vehicle systems, positive train control systems, and wayside devices, not all embodiments of the inventive subject matter are restricted to rail vehicles, positive train control systems, or wayside devices. One or more embodiments of the inventive subject matter may relate to other types or models of vehicle systems, such as automobiles, trucks, buses, mining vehicles, marine vessels, aircraft (manned or unmanned, such as drones), agricultural vehicles, or other off-highway vehicles. One or more embodiments may relate to control systems that control operation of vehicles other than positive train control systems. At least one embodiment relates to sensor assemblies that are not stationary wayside devices or systems.

FIG. 1 schematically illustrates one example of a system 100 that includes a vehicle system 104. The vehicle system can be rail vehicle systems, but optionally can be automobiles, trucks, buses, mining vehicles, marine vessels, aircraft, agricultural vehicles, or other off-highway vehicles. The illustrated vehicle system includes a single vehicle, but optionally can be formed from two or more vehicles that may travel together (by being mechanically coupled or by being mechanically separate but communicating with each other to travel together, such as in a convoy). The vehicle system travels along a route 106, such as tracks, roads, highways, land-based paths, airborne paths, waterways, or the like.

The system 100 can include a protection system 108. The protection system may be disposed off-board the vehicle systems and can include a communication device 122 that communicate with the sensor assembly and/or the vehicle system to control or restrict movement of the vehicle system. For example, the protection system can communicate with the vehicle system to notify the vehicle system where the vehicle system is allowed to travel, how fast the vehicle system is allowed to travel, or the like. The communication device may include the same or similar components as other communication devices described herein.

The protection system can include a controller 124, referred to herein as an off-board controller or a protection system controller. The off-board controller can represent hardware circuitry that includes and/or is connected with one or more processors that perform operations of the protection system. The off-board controller can examine the sensor signal received from the vehicle system and implement one or more responsive actions. As one example, the off-board controller may issue one or More speed restrictions. The speed restrictions can be a designation of one or more segments of the route in which vehicle systems are not allowed to move faster than a designated speed limit (e.g., which is slower than the speed limit of the route and/or than the vehicle systems are capable of moving). The off-board controller can identify the location of one or more vehicle systems and/or route devices based on information included in the sensor signal. A memory 126 of the protection system can store locations of route devices and the corresponding identifications of the route devices, and/or any additional information pertaining to the route devices. Additionally or alternatively, the memory may store information about the vehicle systems that communicate the sensor signals, route information along which the vehicle systems move, or the like.

In one embodiment, the protection system represents a back-office server of a positive train control system. Alternatively, the protection system represents another computerized system that communicates with vehicle systems described herein.

The system 100 may also include a route device 112, such as a switch, that is disposed on the route along which the vehicle system moves. The illustrated route device is a rail switch, but optionally may be a traffic light, a pedestrian gate, landing lights for aerial vehicles, buoys for marine vessels, or the like. For example, the route device may be any alternative device that can control the flow of moving objects along intersecting paths. The paths may be rails, roads, pathways, airspace, waterways, or the like. In the illustrated embodiment, the route device may be a switch that directs the vehicle system to move along a first pathway 130 or along a second pathway 132 based on a position of the switch.

The vehicle system can include one or more sensor assemblies 102 disposed onboard the vehicle system. Optionally, a sensor assembly can be disposed on each vehicle of the vehicle system, or can be disposed on a single vehicle of the vehicle system. The sensor assembly can measure one or more characteristics of the vehicle system. For example, the sensor assembly onboard a first vehicle can measure or detect characteristics of the first vehicle, and a second sensor assembly onboard a second vehicle can measure or detect characteristics of the second vehicle. The sensor assemblies may also measure one or more characteristics of the route and/or the route device. In one or more embodiments, different sensor assemblies may communicate with each other, may communicate with one or more other sensor assemblies offboard the vehicle system, may communicate with the protection system 108, or the like.

Figure 2:
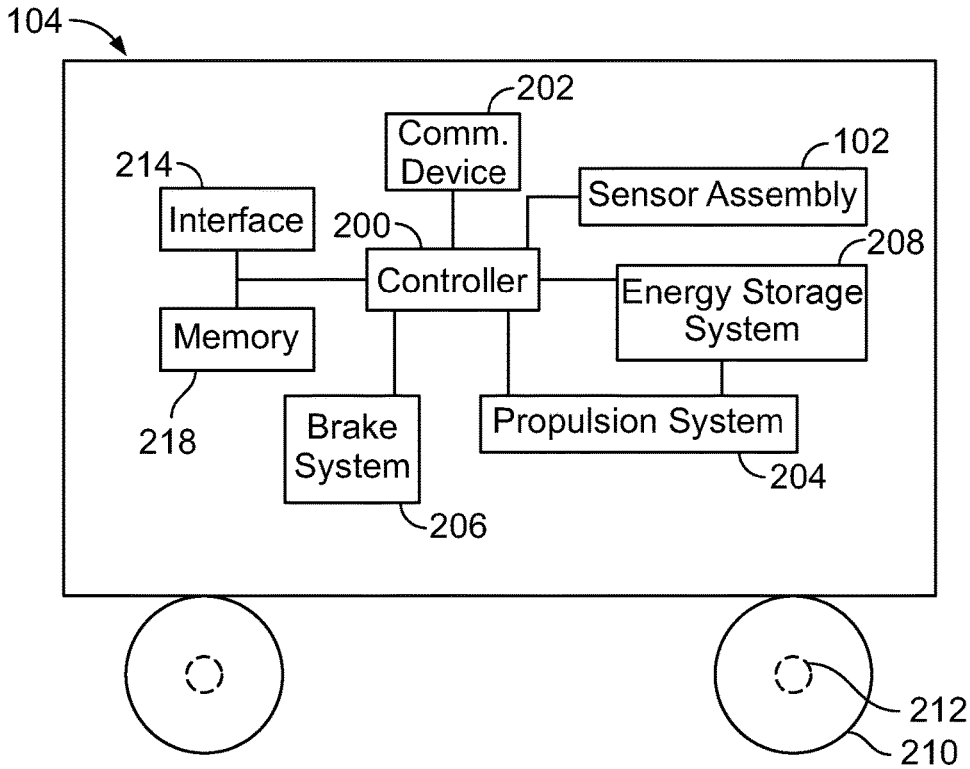
FIG. 2 schematically illustrates one example of a vehicle system.

FIG. 2 schematically illustrates one example of the vehicle system 104 shown in FIG. 1. The vehicle system includes a controller 200, which can be referred to as the onboard controller. The onboard controller can represent hardware circuitry that includes and/or is connected with one or more processors that perform operations described in connection with the onboard controller. The onboard controller can communicate with onboard and/or off-board components via a communication device 202, which may be the same as or similar to the other communication devices described herein. For example, the communication device onboard the vehicle system may wirelessly communicate with the communication device(s) of the protection system, a communication device of another vehicle system, and/or a communication device of another vehicle of the vehicle system.

The vehicle system includes a propulsion system 204 that operates to move the vehicle system along the route. The propulsion system can represent one or more engines, motors, transmissions, propellers, or the like, that generate propulsion to move the vehicle system. The vehicle system also can include a brake system 206 that operates to slow or stop movement of the vehicle system. The brake system can include air brakes, friction brakes, motors (e.g., used for dynamic or regenerative braking), or the like. The onboard controller can communicate control signals with the propulsion system and/or the brake system to control or change movement of the vehicle system.

The vehicle system can include an onboard energy storage system 208 that includes one or more devices that store and/or generate electric current. This current can be used to power components onboard the vehicle system, such as the propulsion system, a lighting system, or the like. Optionally, the energy storage system can include or represent one or more motors of the propulsion system and/or the brake system (e.g., where the motors generate current during regenerative braking). The energy storage system can include one or more batteries, fuel cells, photovoltaic devices, flywheels, alternators, generators, or the like. The onboard controller can communicate control signals to the energy storage system to control supply of the current to one or more components of the vehicle system.

The onboard controller can also control one or more settings or operations of the sensor assembly. The controller may direct different sensors of the sensor assembly to sense at one or more different times, for different lengths of time (e.g., intermittently, continuously, or the like). Optionally the sensor may be an optical sensor, and the onboard controller may control a direction the optical sensor faces and/or orientation of the optical sensor to capture images and/or video of different components of the vehicle system, different segments of the route, or the like.

The sensor assembly can include a communication device that may represent hardware circuitry that can communicate data signals via one or more wired and/or wireless pathways. The communication device can represent transceiving circuity, one or more antennas, modems, or the like. The communication device can receive and provide the data signals to a controller of the sensor assembly. The controller of the sensor assembly can be referred to as a sensor controller. The sensor controller can represent hardware circuitry that includes and/or is connected with one or more processors that perform the operations of the sensor controller described herein.

One or more sensors of the sensor assembly can detect, measure, or otherwise sense one or more characteristics of the vehicle system as the vehicle system moves along the route. As one example, the sensor can determine a position of a first end of the vehicle relative to a latitude and/or longitude, or relative to a second end of the vehicle. As another example, the sensor can be an optical sensor, such as a camera, that outputs images and/or videos of the vehicle system and/or the route. For example, the sensor can generate images and/or videos of the route and/or the route device to identify the route device, to identify damage or other issues with the route device, or the like. These images can also be examined by the sensor controller to identify the route device, identify a location of the route device, and determine a state of the route device. The images and/or video can be obtained to examine the state of the route device, to determine whether the route device is in a correct or incorrect position, to determine a health of the route device, or the like.

In one or more embodiments, the sensor assembly may include two or more sensors disposed on two or more different vehicles of a vehicle system or vehicle consist. For example, one or more sensors of the sensor assembly may be disposed an a first vehicle, and one or more other sensors of the sensor assembly may be disposed on a second vehicle. In one or more embodiments, the sensors of the first vehicle may communicate with the other sensors of the second vehicle. Optionally, the sensors onboard the first vehicle may obtain, or otherwise sense characteristics of the vehicle system, the route, and/or the route device, and the sensors onboard the second vehicle may obtain, or otherwise sense, the same or similar characteristics of the vehicle system, the route, and/or the route device. For example, the sensor assembly may receive sensed information from the sensors onboard the first vehicle, and the sensor assembly may confirm the sensed information from the sensors onboard the first vehicle with sensed information received from sensors onboard the second vehicle.

As one example, the sensors of the first vehicle may sense an acceleration of the vehicle system, and the sensors onboard the second vehicle may sense an acceleration of the vehicle system. If the acceleration sensed by the sensors of the first vehicle systems is substantially the same, match, or otherwise align with the acceleration sensed by the sensors of the second vehicle system, the sensor assembly may confirm a state of the route device, such as a position of the route device. For example, the sensors of the first vehicle may determine the state of the route device, and the sensors of the second vehicle may confirm that the determined state of the route device is correct. Alternatively, the sensors of the second vehicle may determine that the state of the route device is incorrect.

The sensor can include an accelerometer that measures vibrations or other movements of the vehicle system. The sensor can be a radar system that measures a time-of-flight to the vehicle system. This can be used to determine a size of the vehicle system, such as a length of the vehicle system (by identifying changes in the time-of-flight, the leading and trailing ends of the vehicle system can be identified), the number of vehicles in the vehicle system (changes in the time-of-flight can indicate passage of different vehicles), or the like. The sensor can be a lidar system that measures changes in a structured light array. Changes in reflection of the lights in the structured light array can be used to identify the shape of the vehicle system, the size of the vehicle system, the number of vehicles in the vehicle system, or the like.

Optionally, the sensor can include an audible sensor (e.g., a microphone, piezoelectric element, or the like) that senses sounds generated by movement of the vehicle system. These sounds can indicate issues or problems with the vehicle system, damage to the route and/or the route device, or the like. The sensor optionally can measure one or more characteristics of the route, the route device, the environment, of the like. For example, the sensor can examine the route and/or route device to determine whether the route and/or route device is damaged (e.g., by injecting electric signals into conductive portions of the route to determine whether the route and/or route device is broken). The sensor can measure temperatures, wind speed and/or direction, humidity, emissions in the air, or the like, of the environment outside of the vehicle system.

The sensor controller can store characteristic(s) measured by the sensor in a tangible and non-tangible computer-readable storage medium (e.g., memory), such as a computer hard drive, optical disc, server, or the like. The characteristics may be stored for later examination (e.g., accident reconstruction analysis), to identify trends or other changes in the characteristics over time, etc. Optionally, the sensor controller can examine the characteristics of the vehicle, the route, and/or the route device to determine an identification of the route device, identify a location and/or position of the route device, determine a state of the route device, or the like. The sensor controller may generate a sensor signal that can be communicated to the protection system, to another vehicle that moves along the route, to two or more different protection systems, or the like.

Figure 3:
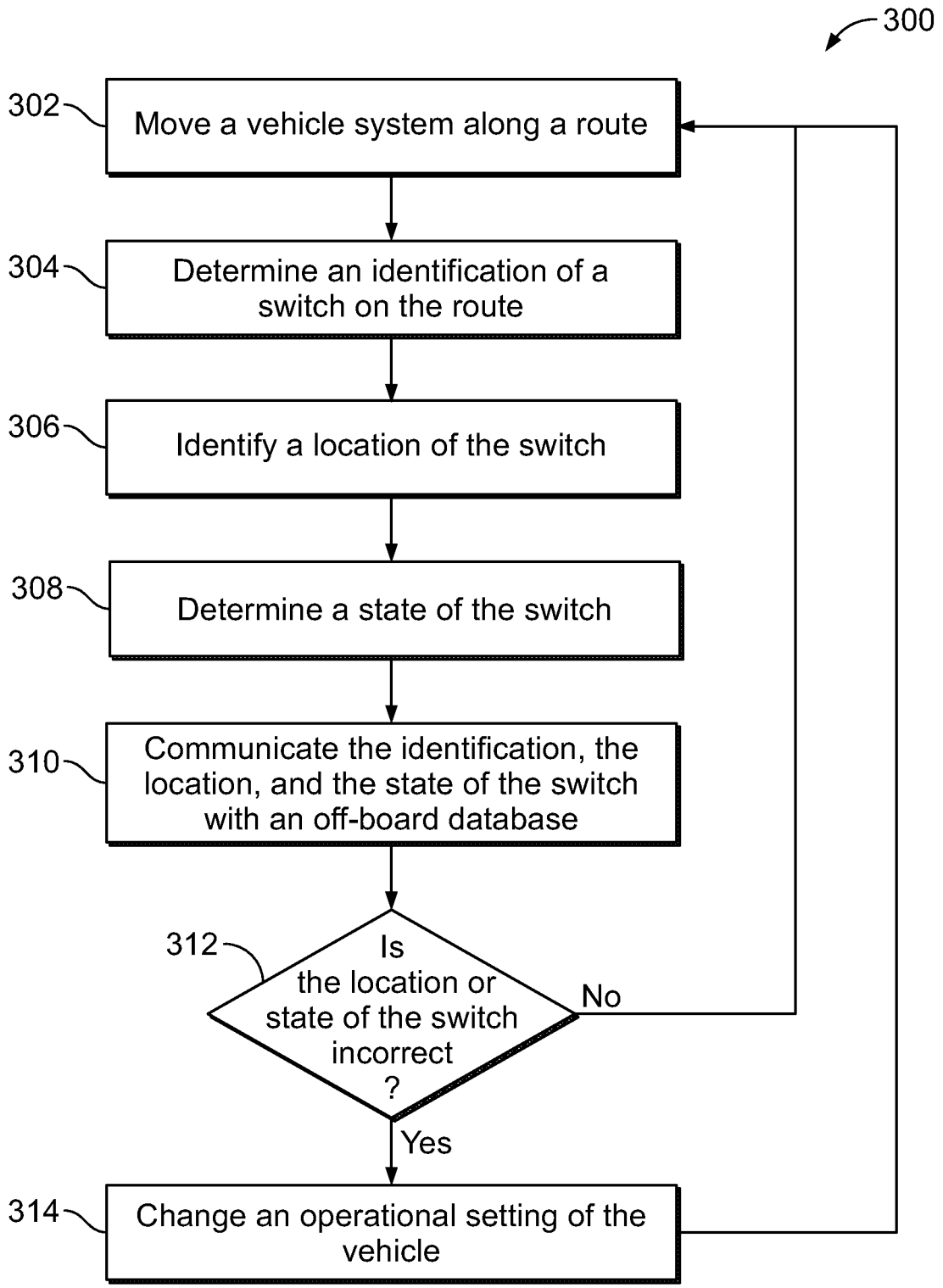
FIG. 3 illustrates a flowchart of one example of a method for controlling operation of a vehicle system.

FIG. 3 illustrates a flowchart of one example of a method for controlling operation of a vehicle system. The method can represent operations performed by the sensor assembly, the protection system, and/or the onboard controller described above. At 302, the vehicle system moves along the route. As the vehicle system moves along the route, the vehicle system may come upon a route device, such as a switch. At 304, the onboard controller determines an identification of the switch. The switch may have an identification or reference number, may be identified based on the style of switch or route device, or may have any alternative identifying features or components. As one example, the sensor assembly may capture an image of the switch that enables the onboard controller to determine the identification of the switch.

At 306 the onboard controller identifies a location of the switch. The location may be a geographical location or may be a location with reference to the route (e.g., the switch is disposed at predetermined distances away or apart from another switch on the route, for example, that the vehicle system previously transversed, etc.).

At 308, a state of the switch is determined. In one embodiment, the state of the switch may refer to a position of the switch. For example, the position may a first position that directs the vehicle system to move along the first pathway 130 (shown in FIG. 1). Alternatively, the position may be a second position that directs the vehicle system to move along the second pathway 132. One or more sensors of the sensor assembly onboard the vehicle system may sense one or more characteristics of the vehicle system, and the onboard controller may determine the position of the switch based on the sensed characteristics of the vehicle system.

As one example, the sensors may sense an orientation of the vehicle system relative to a line of latitude and/or a line of longitude. The orientation of the vehicle system relative to a latitude and/or longitude may indicate if the vehicle system is moving along the first pathway or the second pathway. Based on the movement of the vehicle system, the onboard controller may determine if the switch was in the first position or the second position. As another example, the sensor may determine a position of a first end of a vehicle (e.g., a front end) relative to the latitude and/or longitude, a position of a second end of the vehicle (e.g., a rear end) relative to the latitude and/or longitude, and/or a position of the first end relative to a position of the second end. Optionally, the sensor assembly may determine a position of a first vehicle in a vehicle consist or system relative to a position of a second vehicle of the vehicle consist or system. The vehicle consist may be a platoon, a group, a swarm, a flotilla, or the like, of two or more vehicles that may be mechanically and/or logically coupled with each other.

As another example, the sensors may sense forces on one or more wheels of the vehicle system, indicating that the vehicle system may be moving along a curve. The first pathway may include a curved segment of the route, and the second pathway may not include a curved segment of the route. As another example, the sensor may obtain video or images of the route, and the onboard controller may determine if the vehicle system is moving along the first pathway or the second pathway based on the video or images of the route. The onboard controller may subsequently determine the state or position of the switch based on the vehicle system moving along the first or second pathway.

Optimally, the state of the switch may refer to a health of the switch. For example, the sensor can examine the route and/or route device to determine whether the route and/or route device is damaged by injecting electric signals into conductive portions of the route to determine whether the route and/or route device is broken. Optionally, the onboard controller may review images and/or video of the switch to determine whether the switch, or at least a segment, component, section, or the like, of the switch is broken or deteriorated passed a predetermined threshold. In another embodiment, the vehicle may be an unmanned vehicle (such as a drone), and the drone may fly over the route and capture images of the route device to determine whether the route device is damaged or is in a correct position.

Optionally, the state of the switch may refer to any other aspects of functionality of the route device. For example, the route device may be a traffic light, and the onboard controller may determine whether the traffic light is operating correctly or is operating incorrectly. Optionally, the route device may be a pedestrian gate, and the onboard controller may determine whether the pedestrian gate drops and/or raises at the correct time, drops and/or raises at an incorrect time, remains in place for a predetermined or preset amount of time, or the like. The sensors onboard the vehicle system may sense characteristics of the vehicle, the route, and/or the route device, and the onboard controller may determine the state of the route device based on the characteristics of the vehicle, the route, and/or the route device.

In one or more embodiments, the onboard controller may be disposed on a first vehicle of the vehicle system. The onboard controller may also receive a sensor signal from another vehicle of the vehicle system that indicates the state of the switch determined by the other vehicle of the vehicle system. For example, the onboard controller may confirm the state of the switch based on information received from sensors onboard the other vehicle of the vehicle system.

In one or more embodiments, each of the steps 304, 306, 308 may be completed at substantially the same time, or at different times relative to each other. Optionally, one or more of the steps 304, 306, 308 may not be completed. For example, the onboard controller may determine the location of the switch and the state of the switch, but may not determine the identification of the switch. Optionally, any of the steps of the method 300 may be completed in any alternative order or may be omitted from the method.

At 310, the onboard controller communicates a sensor signal with the off-board database including the identification of the switch, the location of the switch, and/or the state of the switch to the off-board database. For example, the onboard controller may communicate the information to the protection system illustrated in FIG. 1 to confirm the identification, location, and the state of the switch with the off-board database. For example, the off-board controller may receive the sensor signal and confirm that the information received in the sensor signal matches with information the off-board controller has stored in a memory for that switch or route device. Optionally, the off-board controller May confirm that at least some of the information received in the sensor signal does not match with information the off-board controller has stored for that switch.

At 312, the onboard controller and/or an off-board controller at the off-board database may determine if the location of the switch is incorrect. Additionally or alternatively, the onboard controller and/or the off-board database may determine if the state of the switch is incorrect. In one or more embodiments, the onboard controller may also communicate the sensor signal with another vehicle or an alternative vehicle system. Optionally, the onboard controller may be disposed onboard a first vehicle of the vehicle system, and the onboard controller may communicate the sensor signal with one or more other vehicles of the vehicle system. Optionally, the onboard controller may communicate an alert (e.g., to an operator onboard the vehicle system, to the off-board database, to another vehicle that may move along the same route, or the like) that the location of the switch and/or the state of the switch is incorrect.

If the location and the state of the switch are correct, then flow of method proceeds to 302 and the method repeats while the vehicle moves along the route or for a predetermined amount of time or length of travel of the vehicle system. Alternatively, if one or more of the location or the state of the switch are incorrect, flow of the method proceeds to 314.

At 314, one or more operational settings of the vehicle are changed based on determining that the location of the switch and/or the state of the switch are incorrect. For example, based on the location of the route device and/or the state of the route device, in an embodiment where the protection system is or includes a back-office server of a positive train control system, the off-board controller can generate or change a movement authority, a movement bulletin, or a movement schedule for the vehicle system and/or for at least one other vehicle system responsive to receiving the sensor signal. In one embodiment, the off-board controller may remotely change a vehicle speed, gear setting, engine speed, brake engagement, or the like, of the vehicle system. Optionally, the off-board controller may communicate a bulletin to the operator onboard the vehicle system to manually change an operational setting (e.g., brake setting, throttle setting) of one or each of the vehicles of the vehicle system. Optionally, the off-board controller may communicate an alert to the operator.

Optionally, the movement authority, bulletin, or schedule can prevent another vehicle system from traveling into the route device where the vehicle system that was examined is or will be located or stopped. For example, the positive train control system can selectively issue a signal to one or more vehicle systems to prevent those vehicle systems from approaching a route device that may be in an incorrect position, have an incorrect state, or a combination therein.

As one example, the movement authority or bulletin communicated with other vehicle systems may allow the other vehicle systems to approach the route device at normal operating settings. The movement bulletin may include or indicate the known state, position, status, or the like, of the route device. The other vehicle systems, knowing the state, position, and/or status of the route device may continue operating at the vehicle settings (e.g., may not need to reduce a speed of the vehicle system or stop movement of the vehicle system) to verify the state of the route device because the state of the route device was confirmed by the first vehicle system. For example, because the state of the route device is known to the other vehicle systems, the other vehicle systems may not need to also confirm the state of the route device. Alternatively, if the state of the route device is not known to the other vehicle systems, the other vehicle systems may need to change a brake setting and/or a throttle setting to slow or stop movement of the other vehicle systems to confirm the state of the route device. In one or more embodiments, the movement authority or bulletin may communicate the known state of the route device to vehicle systems within a predetermined area proximate to the route device. Optionally, the movement bulletin may identify a time or time stamp indicating when the state of the route device was confirmed, and may include an expiration time indicating a time that the state of the route device may need to be confirmed again.

With respect to a positive train control system as the protection system, the vehicle system may include onboard components that communicate with the positive train control system. These components may limit movement of the vehicle system based on movement authorities, bulletins, etc., that are issued by the back office server (e.g., the off-board controller) of the positive train control system (e.g., the protection system). Different back office servers may be associated with different areas in which the movement authorities, bulletins, etc. are issued. For example, each back office server of several back office servers may issue movement authorities, bulletins, or the like, for the vehicle systems traveling an area associated with that back office server, but not for the vehicle systems traveling in an area associated with another back office server. For example, the onboard controller may automatically communicate with a first back office server (e.g., a first off-board database) when the vehicle system is in a first location, and the onboard controller may automatically communicate with a second back office server (e.g., a second off-board database) when the vehicle system is in a different location, such as a different city, county, state, or the like.

Communication with different back office servers may require onboard components of the vehicle system to have different versions of software, different communication protocols, or the like. A vehicle system having a software version or communication protocol that can communicate with the back office server associated with route segments in one area may not be the correct version or protocol for communicating with another back office server associated with route segments in another area. The vehicle system may need to update or change the software version or communication protocol before entering into and/or traveling within the other area.

The characteristic that is determined by the sensor assembly can include the software version, communication protocol, and/or database content of onboard components of the positive train control system. For example, the sensor can wirelessly communicate with onboard components of the vehicle system to determine the version of software running onboard the vehicle system (that communicates with the off-board controller). As another example, the sensor can communicate with onboard components of the vehicle system to determine the communication protocol used by the onboard components to communicate with the off-board controller. As another example, the sensor can communicate with onboard components of the vehicle system to determine the contents of a database (e.g., memory) onboard the vehicle system. The sensor controller can determine whether any of these characteristics indicates that the vehicle system is able to communicate with a back office server (e.g., the off-hoard controller) or whether a software version change, a change in communication protocol, and/or a modification of the information stored onboard the vehicle system is needed before the vehicle system can communicate with the off-board controller.

If the sensor controller determines that a change in software, communication protocol, and/or database is needed, then the sensor controller can direct the communication device of the sensor assembly to communicate the sensor signal to the vehicle system and/or the back office server. This sensor signal can include the software change, communication protocol change, and/or database change, or can direct the vehicle system to obtain the software, protocol, and/or database change. This can ensure that the vehicle system has the correct or proper software version, communication protocol, and/or database content for entering into and/or traveling within an area associated with a back office server of a positive train control system.

In one or more embodiments of the subject matter described herein, a method includes determining an identification of a switch on a route along which a vehicle moves using one or more sensors onboard the vehicle. A location of the switch is identified with the one or more sensors. A state of the switch is determined with the one or more sensors. The identification of the switch, location of the switch, and the state of the switch are communicated with an off-board database.

Optionally, the method may include confirming receipt of the identification of the switch, the location of the switch, and the state of the switch with the off-board database.

Optionally, the off-board database may be a first off-board database. The identification of the switch, the location of the switch, and the state of the switch may be communicated with the first off-board database when the vehicle is in a first location, and communicated with a second off-board database when the vehicle is in a second position.

Optionally, determining the state of the switch may include determining a direction of movement of the vehicle relative to one or more of a latitude or a longitude.

Optionally, the vehicle has a first end and a second end. Determining the state of the switch may include one or more of determining a position of the first end of the vehicle relative to one or more of a latitude or a longitude, or determining a position of the second end of the vehicle relative to one or more of the latitude or the longitude.

Optionally, the method may include communicating the identification of the switch, the location of the switch, and the state of the switch with another vehicle.

Optionally, the vehicle is a first vehicle of one or more vehicles of a vehicle consist. The method may include confirming the state of the switch with one or more sensors of a second vehicle of the one or more vehicles of the vehicle consist.

Optionally, the vehicle may be a first vehicle of one or more vehicles of a vehicle consist. The method may include communicating the identification of the switch, the location of the switch, and the state of the switch with a second vehicle of the one or more vehicles of the vehicle consist.

Optionally, the method may include determining that one or more of the location of the switch is incorrect or that the state of the switch is incorrect, and communicating an alert based on determining that one or more of the location of the switch is incorrect or the state of the switch is incorrect.

Optionally, the method may include changing one or more operational settings of the vehicle based on determining that one or more of the location of the switch is incorrect or the state of the switch is incorrect.

In one or more embodiments of the subject matter described herein, a vehicle system includes one or more sensors disposed onboard a vehicle that may sense one or more characteristics of the vehicle. The vehicle system includes one or more processors configured to determine an identification of a switch on a route along which the vehicle moves, identify a location of the switch, determine a state of the switch, and communicate the identification of the switch, the location of the switch, and the state of the switch with an off-board database.

Optionally, the one or more processors may confirm receipt of the identification of the switch, the location of the switch, and the state of the switch with the off-board database.

Optionally, the off-board database is a first off-board database. The one or more processors may communicate the identification of the switch, the location of the switch, and the state of the switch with the first off-board database when then vehicle is in a first position, and communicate with a second off-board database when the vehicle is in a second position.

Optionally, the one or more processors may determine the state of the switch by determining a direction of movement of the vehicle relative to one or more of a latitude or longitude.

Optionally, the vehicle has a first end and a second end, and the one or more processors may determine the state of the switch by one or more of determining a position of the first end of the vehicle relative to one or more of a latitude or a longitude, or determine a position of the second end of the vehicle relative to one or more of the latitude or longitude.

Optionally, the one or more processors may communicate the identification of the switch, the location of the switch, and the state of the switch with an alternative vehicle.

Optionally, the vehicle may be a first vehicle of one or more vehicles of a vehicle consist. The one or more processors may confirm the state of the switch with one or more sensors of a second vehicle of the one or more vehicles of the vehicle consist.

Optionally, the vehicle is a first vehicle of one or more vehicles of a vehicle consist. One or more processors of aa second vehicle of the one or more vehicles of the vehicle consist may communicate the identification of the switch, the location of the switch, and the state of the switch with the of board database.

Optionally, the one or more processors may determine that one or more of the location of the switch is incorrect or the state of the switch is incorrect, and may communicate an alert based on one or more of the location of the switch being incorrect or the state of the switch being incorrect.

In one or more embodiments of the subject matter described herein, a method may include determining an identification of a switch on a route along which a first vehicle of a vehicle consist moves using one or more sensors onboard the first vehicle. A location of the switch may be identified with the one or more sensors. A state of the switch may be determined with the one or more sensors. The state of the switch may be confirmed using one or more sensors onboard a second vehicle of the vehicle consist. The identification of the switch, the location of the switch, and the state of the switch may be communicated with an off-board database to confirm the identification of the switch, the location of the switch, and the state of the switch with the off-board database.

Optionally, the method may include determining that one or more of the location of the switch is incorrect or that the state of the switch is incorrect, and communicating an alert based on determining that one or more of the location of the switch is incorrect or the state of the switch is incorrect.

Optionally, the method may include changing one or more operational settings of one or move vehicles of the vehicle consist based on determining that one or more of the location of the switch is incorrect or the state of the switch is incorrect.

As used herein, the terms "processor" and "computer," and related terms e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A method comprising:

determining an identification of a switch on a route along which a vehicle moves using one or more sensors onboard the vehicle;

identifying a location of the switch with the one or more sensors;

determining a position of the switch with the one or more sensors;

communicating the identification of the switch, the location of the switch, and the position of the switch with an off-board database;

comparing the location of the switch and the position of the switch with stored data associated with the switch, the stored data associated with the switch including stored location data and stored position data; and communicating an alert based on one or more differences between one or both of the location of the switch or the position of the switch and the stored data.

2. The method of claim 1, further comprising confirming receipt of the identification of the switch, the location of the switch, and the position of the switch with the off-board database.

3. The method of claim 1, wherein the off-board database is a first off-board database, further comprising communicating the identification of the switch, the location of the switch, and the position of the switch with the first off-board database when the vehicle is in a first location, and communicating the identification of the switch, the location of the switch, and the position of the switch with a second off-board database when the vehicle is in a second location.

4. The method of claim 1, wherein determining the position of the switch includes determining a direction of movement of the vehicle relative to one or more of a latitude or a longitude.

5. The method of claim 1, wherein the vehicle has a first end and a second end, wherein determining the position of the switch includes one or more of determining a position of the first end of the vehicle relative to one or more of a latitude or a longitude, or determining a position of the second end of the vehicle relative to one or more of the latitude or the longitude.

6. The method of claim 1, further comprising communicating the identification of the switch, the location of the switch, and the position of the switch with another vehicle.

7. The method of claim 1, wherein the vehicle is a first vehicle of one or more vehicles of a vehicle consist, further comprising confirming the position of the switch with one or more sensors of a second vehicle of the one or more vehicles of the vehicle consist.

8. The method of claim 1, wherein the vehicle is a first vehicle of one or more vehicles of a vehicle consist, further comprising communicating the identification of the switch, the location of the switch, and the position of the switch with a second vehicle of the one or more vehicles of the vehicle consist.

9. The method of claim 1, further comprising determining that one or more of the location of the switch is incorrect or that the position of the switch is incorrect responsive to comparing of the location of the switch and the position of the switch with stored data associated with switch, and communicating an alert based on determining that one or more of the location of the switch is incorrect or the position of the switch is incorrect.

10. The method of claim 9, further comprising changing one or more operational settings of the vehicle based on determining that one or more of the location of the switch is incorrect or the position of the switch is incorrect.

11. A vehicle system comprising:

one or more sensors disposed onboard a vehicle configured to sense one or more characteristics of the vehicle; and one or more processors configured to one or more of:

determine an identification of a switch on a route along which the vehicle moves;

identify a location of the switch;

determine a position of the switch;

communicate the identification of the switch, the location of the switch, and the position of the switch with an off-board database, wherein the one or more processors are configured to compare the location of the switch and the position of the switch with stored data associated with the switch, the stored data associated with the switch including stored location data and stored position data, and wherein the one or more processors are configured to communicate an alert based on one or more differences between one or both of the location of the switch or the position of the switch and the stored data.

12. The vehicle system of claim 11, wherein the one or more processors are configured to confirm receipt of the identification of the switch, the location of the switch, and the position of the switch with the off-board database.

13. The vehicle system of claim 11, wherein the off-board database is a first off-board database, wherein the one or more processors are configured to communicate the identification of the switch, the location of the switch, and the position of the switch with the first off-board database when the vehicle is in a first position, and communicate the identification of the switch, the location of the switch, and the position of the switch with a second off-board database when the vehicle is in a second location.

14. The vehicle system of claim 11, wherein the one or more processors are configured to determine the position of the switch by determining a direction of movement of the vehicle relative to one or more of a latitude or a longitude.

15. The vehicle system of claim 11, wherein the vehicle has a first end and a second end, wherein the one or more processors are configured to determine the position of the switch by one or more of determining a position of the first end of the vehicle relative to one or more of a latitude or a longitude, or determining a position of the second end of the vehicle relative to one or more of the latitude or the longitude.

16. The vehicle system of claim 11, wherein the one or more processors are configured to communicate the identification of the switch, the location of the switch, and the position of the switch with an alternative vehicle.

17. The vehicle system of claim 11, wherein the vehicle is a first vehicle of one or more vehicles of a vehicle consist, wherein the one or more processors are configured to confirm the position of the switch with one or more sensors of a second vehicle of the one or more vehicles of the vehicle consist.

18. The vehicle system of claim 11, wherein the vehicle is a first vehicle of one or more vehicles of a vehicle consist, wherein one or more processors of a second vehicle of the one or more vehicles of the vehicle consist are configured to communicate the identification of the switch, the location of the switch, and the position of the switch with the off-board database.

19. The vehicle system of claim 11, wherein the one or more processors are configured to determine that one or more of the location of the switch is incorrect or that the position of the switch is incorrect responsive to comparing the location of the switch and the position of the switch with the stored data, and communicate an alert based on one or more of the location of the switch being incorrect or the position of the switch being incorrect.

20. A method comprising:

determining an identification of a switch on a route along which a first vehicle of a vehicle consist moves using one or more sensors onboard the first vehicle;

identifying a location of the switch with the one or more sensors;

determining a position of the switch with the one or more sensors;

confirming the position of the switch using one or more sensors onboard a second vehicle of the vehicle consist;

communicating the identification of the switch, the location of the switch, and the position of the switch with an off-board database to confirm the identification of the switch, the location of the switch, and the position of the switch with the off-board database; and communicating the identification of the switch, the location of the switch, and the position of the switch with a second vehicle.

* * * * *